US008172416B2

(12) United States Patent
Chan

(10) Patent No.: US 8,172,416 B2
(45) Date of Patent: May 8, 2012

(54) COMBINED RADIATOR AND LIGHTING ASSEMBLY

(75) Inventor: Paul Kam Ching Chan, Hong Kong (CN)

(73) Assignee: Transcanasia International (Holdings) Limited, Hong Kong (CN)

( * ) Notice: Subject to any disclaimer, the term of this patent is extended or adjusted under 35 U.S.C. 154(b) by 566 days.

(21) Appl. No.: 12/223,777

(22) PCT Filed: Feb. 9, 2007

(86) PCT No.: PCT/CN2007/000453

§ 371 (c)(1),
(2), (4) Date: May 27, 2009

(87) PCT Pub. No.: WO2007/090354

PCT Pub. Date: Aug. 16, 2007

(65) Prior Publication Data

US 2009/0296376 A1 Dec. 3, 2009

Related U.S. Application Data

(60) Provisional application No. 60/771,450, filed on Feb. 9, 2006.

(51) Int. Cl.
*F21V 33/00* (2006.01)

(52) U.S. Cl. ..... 362/92; 362/294; 126/92 A; 126/92 B; 392/411; 219/220

(58) Field of Classification Search ..... 362/92, 362/126, 179–182, 253, 261, 276, 294, 312, 362/37; 126/92 A, 92 B, 255; 392/407–430; 219/220–229, 399, 405–411

See application file for complete search history.

(56) References Cited

U.S. PATENT DOCUMENTS

| | | | | |
|---|---|---|---|---|
| 1,917,461 | A * | 7/1933 | Rankin | 392/428 |
| 3,792,230 | A * | 2/1974 | Ray | 392/410 |
| 4,728,777 | A | 3/1988 | Tsisios et al. | |
| 4,739,152 | A * | 4/1988 | Downs | 392/421 |
| 5,805,769 | A | 9/1998 | Cook et al. | |
| 6,381,407 | B2 * | 4/2002 | Choi | 392/376 |
| 6,499,480 | B2 * | 12/2002 | Ashton et al. | 126/92 B |
| 2004/0152028 | A1 * | 8/2004 | Singh et al. | 431/328 |
| 2004/0177843 | A1 * | 9/2004 | Bernini et al. | 126/92 AC |
| 2004/0226551 | A1 * | 11/2004 | Duphily et al. | 126/92 B |

FOREIGN PATENT DOCUMENTS

| | | | |
|---|---|---|---|
| CN | 1490586 | A | 4/2004 |
| JP | 60060453 | A | 4/1985 |
| JP | 03160218 | A * | 7/1991 |
| JP | 4043258 | A | 2/1992 |
| WO | WO-2005/078356 | A1 | 8/2005 |

* cited by examiner

*Primary Examiner* — Hargobind S Sawhney

(74) *Attorney, Agent, or Firm* — Birch, Stewart, Kolasch & Birch, LLP

(57) ABSTRACT

A combined radiator and lighting assembly is provided. The combined assembly includes at least a first radiation member and a second radiation member each powered by an energy source, and a reflective member including an at least partially ring-shaped concave reflective surface facing at least the first radiation member which includes an at least partial ring shape for distributing energy to an at least partially ring-shaped zone. The second radiation member includes a lamp base assembly, adapted to be received in a lamp socket assembly, to provide illumination or other forms of radiation, with concentration in a focal zone or area, or dispersion over the focal zone or area.

19 Claims, 6 Drawing Sheets

COMBINED RADIATOR AND LIGHTING ASSEMBLY

CROSS-REFERENCE TO RELATED APPLICATION

This application is the National Phase of PCT/CN2007/000453 filed on Feb. 9, 2007, which claims priority under 35 U.S.C. 119(e) to U.S. Provisional Application No. 60/771,450 filed on Feb. 9, 2006, the entire contents of which are hereby incorporated by reference.

BACKGROUND OF THE INVENTION

1. Field of the Invention

The present invention relates to a combined radiator and lighting assembly. In particular, the present invention relates to a novel combo type radiation and lighting assembly for concentrating or dispersing energy and illumination.

2. Description of Background Art

Lamps and lighting equipment and heat radiant apparatuses have been used as separate devices at home, church, or other places of commerce to provide a warm and illuminated atmospheric and environment and at times with decorative elegance.

PCT Patent Publication No. WO 2005/078356 ("the '356 Publication"), which we incorporate by reference, discloses different kinds of radiators.

What is desired is a combined radiator and lighting assembly that can provide both heat radiation and illumination. By means of an opening and hollow section formed at or near the bottom or middle segment of the said radiant heater in conjunction with at least one special designed lamp socket assembly adapted for receiving at least one light source or other radiation source, the combo type radiation and lighting assembly improves on the radiator in the '356 Publication and can provide radiation within the desired irradiated zone while affording illumination or other forms of radiation, with concentration in a smaller focal zone or area, or dispersion over a larger zone or area.

SUMMARY AND OBJECTS OF THE INVENTION

The present invention is directed to a combined radiator and lighting assembly. In one aspect, radiation within the desired irradiation zone is provided while affording illumination or other forms of radiation, with concentration in a smaller focal zone or area or dispersion over a larger zone or area. It is a further aspect to provide a year-round ceiling-mounted, wall-mounted or otherwise mounted or secured combo type radiator and lighting apparatus, which can provide person(s) sitting near or underneath the radiator and lighting apparatus with illumination and/or infrared irradiation (in numerous possible hybrids, permutations and combinations of concentration and dispersion of various forms of illumination for lighting and/or other forms of radiation, including without limitation, infrared radiation and/or ultraviolet radiation for heating within a selected smaller or larger, as the case may, focal zone or area) as and when such person(s) desire without the need for storage of the combo type radiator and lighting apparatus during the periods of warmer climate, nor the need for storage of dangerous fuel as in the case of gas or propane heaters.

As visible light and other forms of radiation are parts of the electromagnetic spectrum, the implementation of the disclosed invention or method to focus, concentrate and direct irradiation from a radiation source to and at a selected zone or object can be simultaneously or conjunctively used with other optical apparatuses, including, but without limitation, fiber optic bundle or apparatus and/or optical lens (including, but without limitation, a prism), mirrors, reflective surfaces or a hybrid, permutation or combination whereof, to achieve the desired goal.

The present invention has an enormously wide scope of applications and users (thus its commercial and industrial value being great) including, but without limitation, focusing, concentrating and directing radiation to or at:

(a) selected area or zone of radiation absorbent surface, object, substance and/or matter on satellite or other astronomic equipment and/or apparatuses in space to achieve an increase in the temperature of such selected area or zone of absorbent surface, object, substance and/or matter relative to its environment or to achieve a temperature differential of said selected area or zone and its environment and providing thrust, torque and propulsion forces in relation to (amongst other things) matters of attitude of satellite or other astronomic equipment and/or apparatuses in space relative to the Sun or other extra-terrestrial body or bodies;

(b) selected radiation absorbent surface, object, substances and/or matter (including, but without limitation, food and other materials) to be manufactured, assembled, installed, erected, constructed, located, repaired, maintained, enjoyed, occupied, consumed, used, or handled (whether indoors or outdoors) by any person, object or thing (including, but without limitation, computerized robotics and cybernetics) in cold weather on Earth, in space or on any other extra-terrestrial or heavenly bodies;

(c) bodies or body tissues (living or dead) or other objects (including, but not limited to objects or subjects of scientific research or medical operations and treatments) and food stuffs in cooking and culinary preparations; and (d) objects, substances and/or matters (including, but without limitation, food and other materials) that require an increase in its temperature relative to its environment through focused, concentrated or directed or re-directed radiation.

Figure 1A:
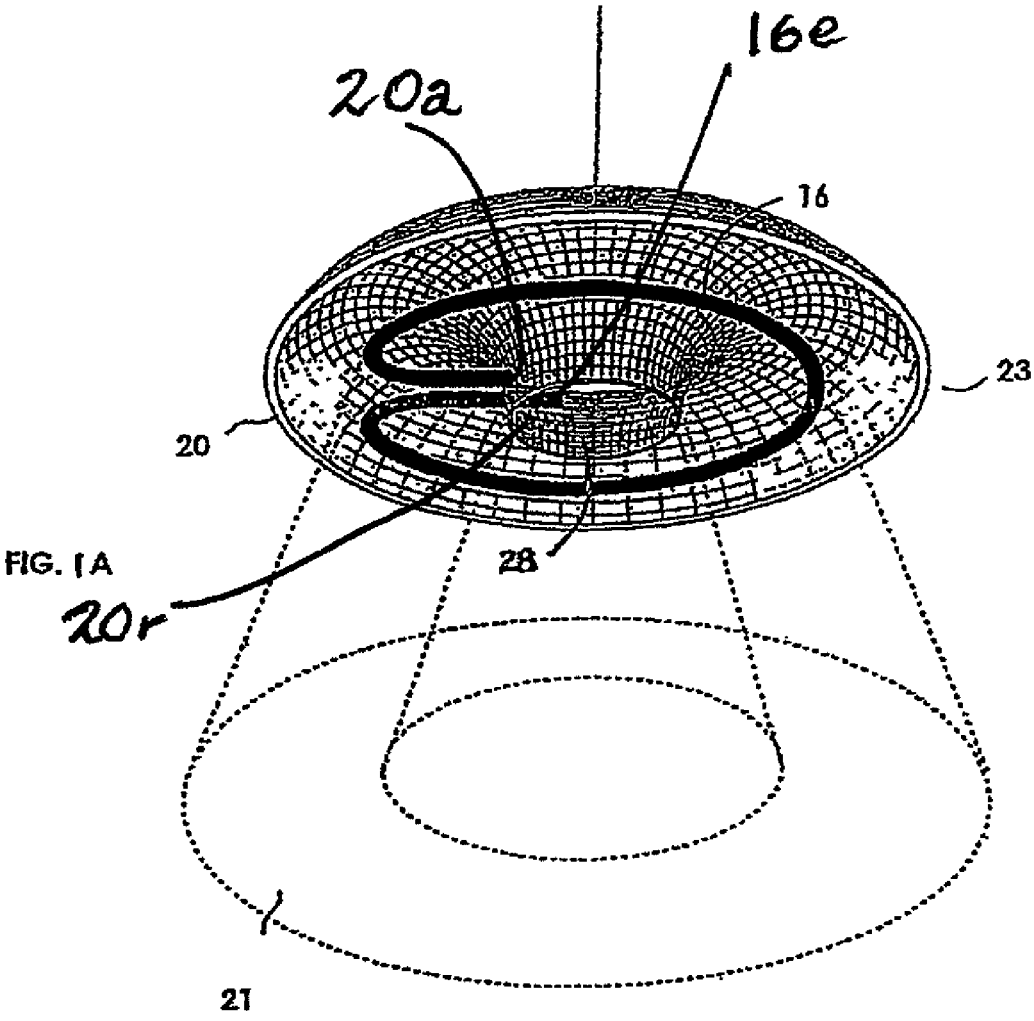
FIG. 1A is a perspective view of a radiator.
Figure 1B:
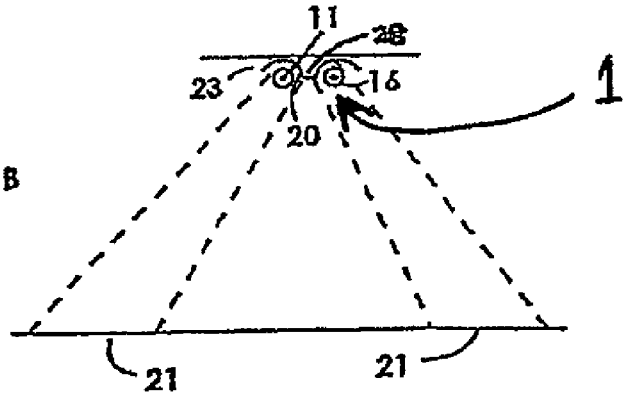
FIGS. 1B and 1C are side cross-sectional views of the radiator of FIG. 1A.
Figure 1C:
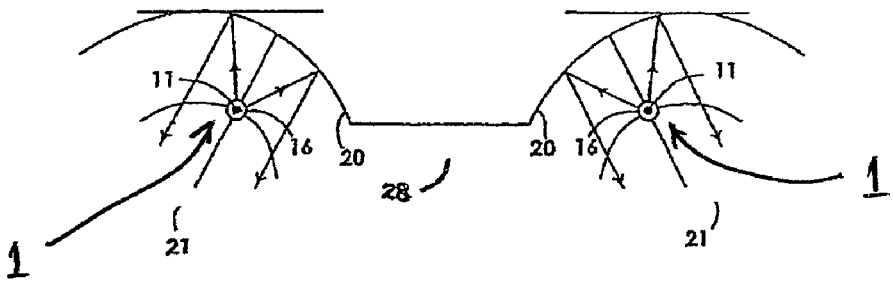
Figure 1D:
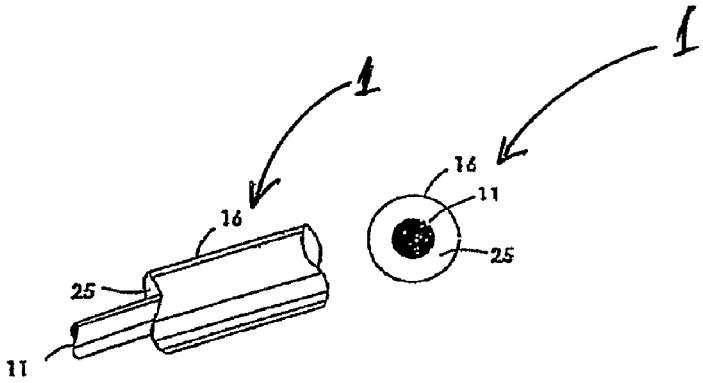
FIG. 1D is perspective view and a side cross-sectional view of a radiation member of the radiator of FIG. 1A.
Figure 4A:
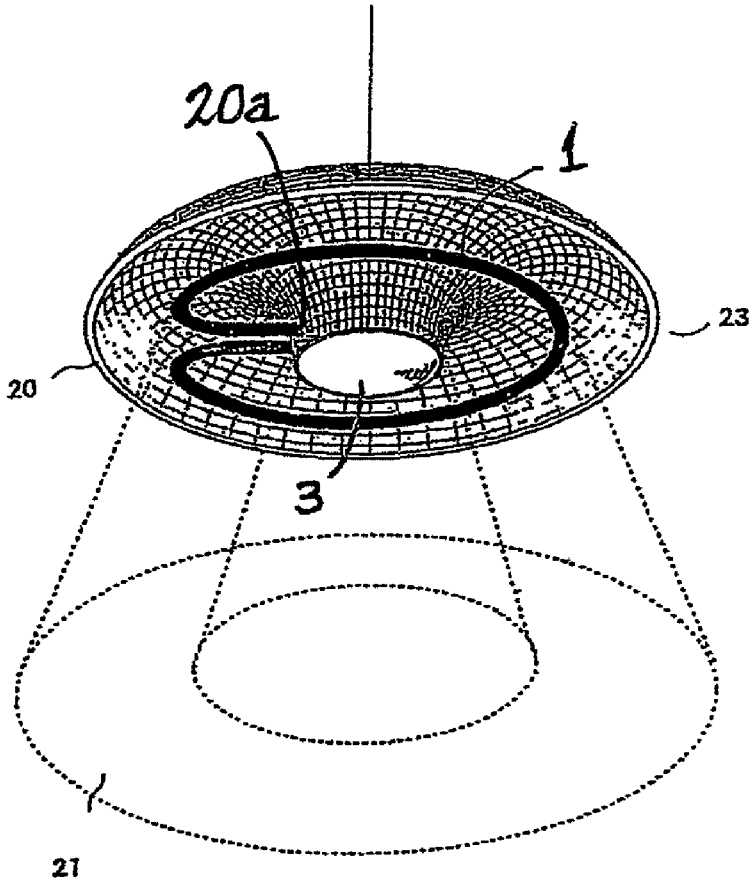
FIG. 4A is a perspective view of a combo type radiation and lighting assembly in accordance with the present invention.

DETAILED DESCRIPTION (A) One embodiment is shown in FIG. 4A comprising a first radiation member 1 and a second radiation member 3. The first radiation member 1 is constructed with electrical resistance (heating member) 11 or other heating elements embedded in and surrounded by electricity insulation and thermal conductive materials (including, but without limitation, gaseous or solid materials, oxides, sesquioxides, carbides, hydrates or nitrates of silicon materials or electro fused magnesium oxides) in tubular casing 16 as shown in FIG. 1A (comprising one or more materials or matters selected from a group consisting (amongst others) of stainless steel, low carbon steel, aluminum, aluminum alloys, aluminum-iron alloys, chromium, molybdenum, manganese, nickel, niobium, silicon, titanium, zirconium, rare-earth minerals or elements (including, without limitation, cerium, lanthanum, neodymium and yttrium), and ceramics, nickel-iron alloys, nickel-iron-chromium alloys, nickel-chromium alloys, nickel-chromium-aluminum alloys, and other alloys alike, and oxides, sesquioxides, carbides and nitrides whereof, or a mixture alloys or oxides, sesquioxides, carbides, hydrates or nitrates whereof, certain carbonaceous materials and other infrared radiating materials) is placed before a generally circular hat-shaped or ring-shaped reflective element 23 constructed of good reflective materials, in the form as shown in FIG. 1C, the end(s) of the first radiation member 1 being turned towards and passing through aperture(s) on the concave reflective surface 20 and stowed and secured at appropriate location(s) within the recess(es) behind the concave reflective surface 20 (with desirable and appropriate safety features known by those skilled in the art) so that a point on the first radiation member 1 facing the generally circular hat-shaped or ring-shaped reflective element 23 is positioned at or near the center point or focal zone of the corresponding segment of the concave reflective surface 20 of the generally circular hat-shaped or ring-shaped reflective element 23 and the radiation emitted from such point on the radiation source is directed or reflected away from the concave reflective surface 20 substantially in the manner as shown in FIG. 1C. As can be seen in FIG. 1A, end(s) 16*e* of the tubular casing 16 of the electrical resistance (heating member) 11 is/are turned towards and pass through aperture(s) 20*a* on the concave reflective surface 20 of the reflective element 23. The end(s) 16*e* is/are stowed and secured at location(s) within the recess(es) 20*r* behind the concave reflective surface 20. The radial cross-section of the tubular casing 16 as shown in FIG. 1D may comprise (without limitation) oxides, sesquioxides, carbides, hydrates or nitrates of silicon materials or electro fused magnesium oxides and take generally circular, triangular, rectangular, polygonal or elliptical shapes, or hybrids and/or combinations whereof in light of the shape of the generally circular hat-shaped or ring-shaped reflective element with a view to maximizing the effect of the irradiation for the selected purposes. The concave reflective surface 20 of the generally circular hat-shaped or ring-shaped reflective element 23 may be conic (being spherical, paraboloidal, ellipsoidal, hyperboloidal) or other surfaces that can be generated from revolution, or in other manner, of quadratic, cubic or other equations. The radiation emitted from the generally circular hat-shaped or ring-shaped reflective element 23 is concentrated mainly within the irradiated zone 21 as shown in FIG. 1A and FIG. 1B for the purposes of heating or irradiating bodies, objects, substances or matters (including, but without limitation, food and other materials) placed or found within the irradiated zone 21, with a view to saving or maximizing the efficient use of energy emitted from the radiation source and whilst reducing or minimizing the effect of radiation on other bodies, objects, substances or matter (including, but without limitation, food and other materials) not within the irradiated zone 21 as shown in FIG. 1A and FIG. 1B. The second radiation member 3 may comprise (where appropriate, in conjunction with other radiation source(s) or light source(s)) at least one light source (the radial axes of which may be set perpendicular or at different angle(s) to the perpendicular) coupled with lamp base assembly 60 (including, without limitation, aluminized reflector lamp; parabolic aluminized reflector lamp; standard incandescent lamp; reflector incandescent lamp; tungsten halogen lamp; halogen infrared reflecting lamp; filament lamp; compact fluorescent lamp; linear fluorescent lamp; induction lamp; metal halide lamp; sodium lamp; mercury lamp; high intensity discharge lamp; light emitting diode lamp; ultra-violet lamp; neon lamp; quartz lamp; sensor lamp; down light; electroluminescent light; flood light; solar light; spot light) which fits into lamp socket assembly 29, located within the hollow section 28 (as shown in FIG. 1A) on, in or forming at least part of the device, designed for receiving such light source(s) with accompanying lamp base assembly 60 as shown in FIG. 4A and FIG. 4C.

Figure 2A:
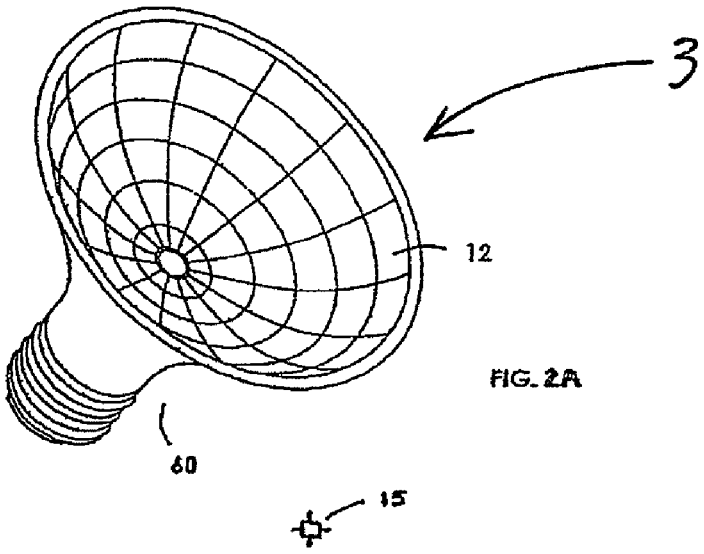
FIG. 2A is a perspective view of a radiator with a lamp base assembly.
Figure 2B:
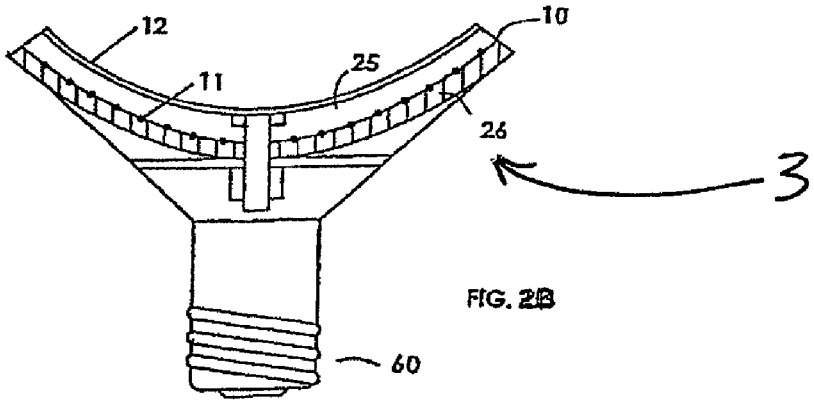
FIG. 2B is a side cross-sectional view of the radiator and the lamp base assembly of FIG. 2A.
Figure 4B:
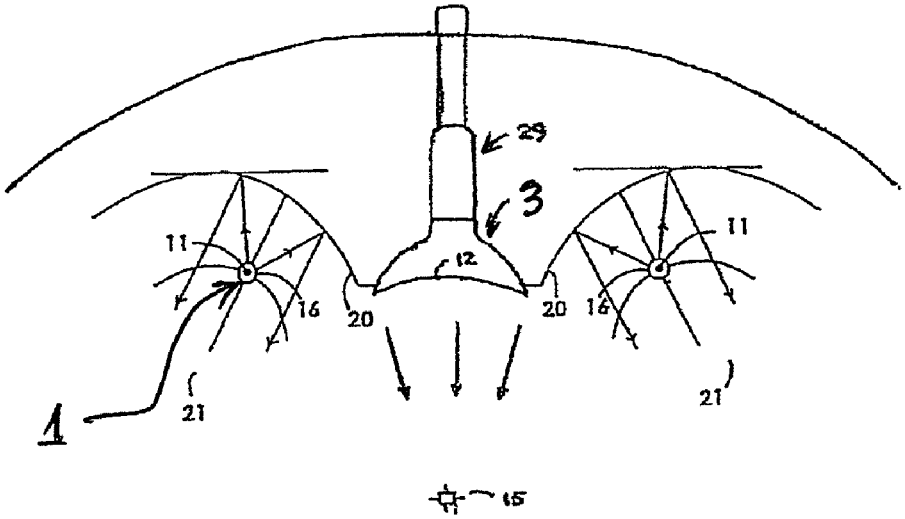
FIGS. 4B and 4C are side cross-sectional views of the combo type radiation and lighting assembly of FIG. 4A.

(B) In another embodiment as described in Paragraph (A) above, the second radiation member 3 may comprise (where appropriate, in conjunction with other radiation source(s) or light source(s)) at least one device as shown in FIG. 2A, which includes a device coupled with lamp base assembly 60 with a longitudinal axis through the center point or focal zone of the spherical segment 12. The second radiation member 3 is constructed with a radiation layer (heating layer) 10 with electrical resistance or other heating elements (heating member) 11 embedded in and surrounded by electricity insulation and thermal conductive materials 25 (including, but without limitation, gaseous or solid materials, oxides, sesquioxides, carbides, hydrates or nitrates of silicon materials or electro fused magnesium oxides) on the one side facing the convex surface of spherical segment 12 and thermal insulation materials 26 on the other side. Such embodiment (with desirable and appropriate safety features known by those skilled in the art) will fit into lamp socket assembly 29 designed for receiving such devise with its accompanying lamp base assembly 60. Such a device comprises a radiation layer (heating layer) 10 positioned on the convex surface of the spherical segment 12 and lamp base assembly 60, which is accepted by lamp socket assembly 29 in a manner as if it were an electric lamp. Radiation layer (heating layer) 10 may comprise of any device or apparatus capable of increasing the surface temperature of the spherical segment 12 to the suitable levels and infrared radiation is focused or concentrated at or towards the center point or focal zone of the spherical segment 12 over a smaller area or zone as shown in FIG. 4A and FIG. 4B.

Figure 3A:
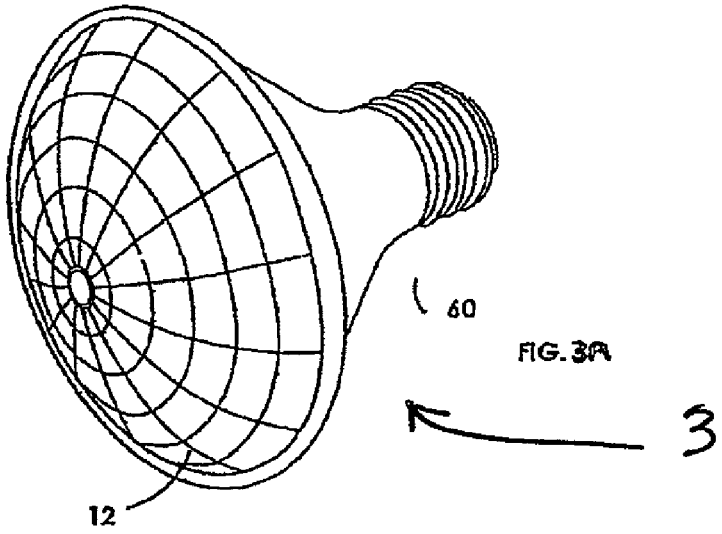
FIG. 3A is a perspective view of a radiator with a lamp base assembly.
Figure 3B:
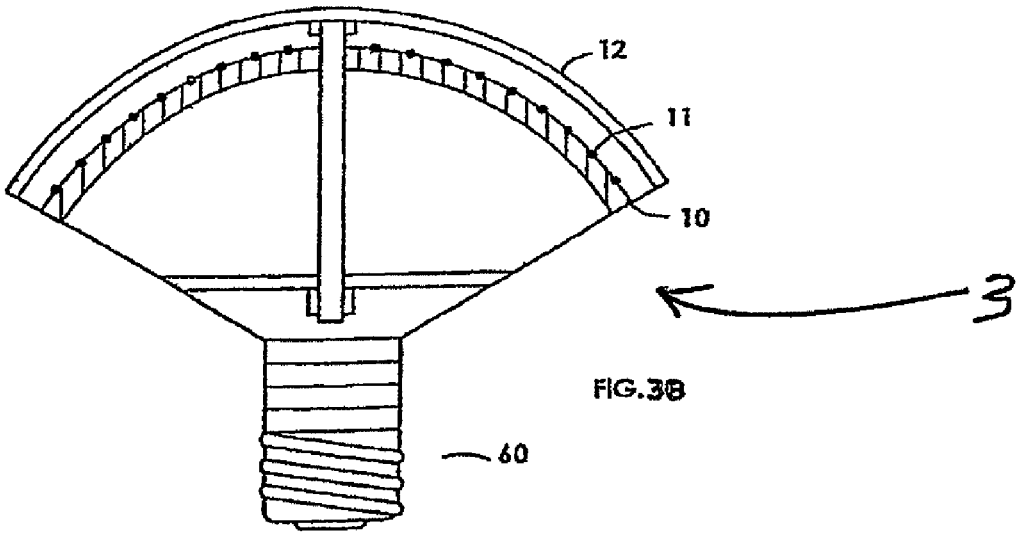
FIG. 3B is a side cross-sectional view of the radiator and the lamp base assembly of FIG. 3A.

(C) In yet another embodiment of such device as described in Paragraph (A) above, the second radiation member 3 may comprise (where appropriate, in conjunction with other radiation source(s) or light source(s)) at least one device as shown in FIG. 3A, which includes a device coupled with lamp base assembly 60 with a longitudinal axis through the center point or focal zone 15 of the spherical segment 12. The radiation layer (heating layer) 10 is constructed with electrical resistance or other heating elements 11 embedded in and surrounded by electricity insulation and thermal conductive materials 25 (including, but without limitation, gaseous or solid materials, oxides, sesquioxides, carbides, hydrates or nitrates of silicon materials or electro fused magnesium oxides) on the one side facing the concave surface of spherical segment 12 and thermal insulation materials 26 on the other side. Such embodiment (with desirable and appropriate safety features known by those skilled in the art) will fit into lamp socket assembly 29 designed for receiving such devise with its accompanying lamp base assembly 60. Such a device comprises a radiation source 10 positioned on the concave surface of the spherical segment 12 and lamp base assembly 60, which is accepted by lamp socket assembly 29 in a manner as if it were an electric lamp. Radiation layer (heating layer)

Figure 4C:
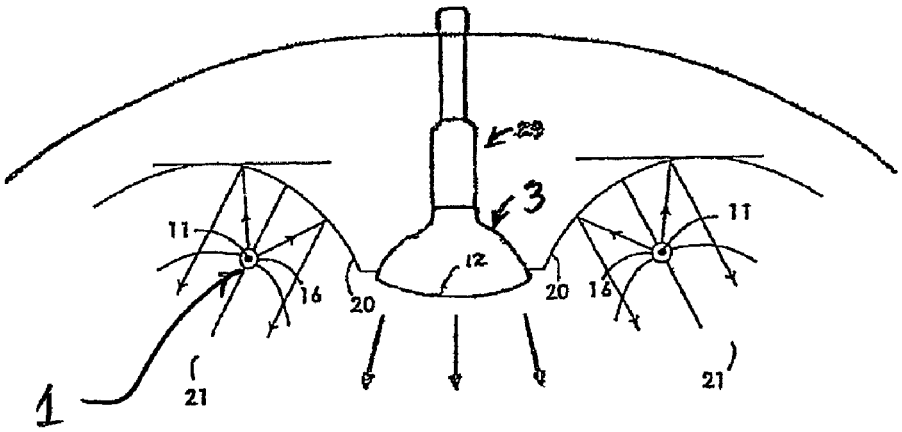

10 may comprise of any device or apparatus capable of increasing the surface temperature of the spherical segment 12 to the suitable levels and infrared radiation is distributed or dispersed away from the center point or focal zone 15 of the spherical segment 12 over a larger area or zone as shown in FIG. 4A and FIG. 4C.

Those of skill in the art are fully aware that, numerous hybrids, permutations, modifications, variations and/or equivalents (for example, but without limitation, certain aspects of spherical bodies, shapes and/or forms are applicable to or can be implemented on paraboloidal, ellipsoidal and/or hyperboloidal bodies, shapes and/or forms) of the present invention and in the particular embodiments exemplified, are possible and can be made in light of the above invention and disclosure without departing from the spirit thereof or the scope of the claims in this disclosure. It is important that the claims in this disclosure be regarded as inclusive of such hybrids, permutations, modifications, variations and/or equivalents. Those of skill in the art will appreciate that the idea and concept on which this disclosure is founded may be utilized and exploited as a basis or premise for devising and designing other structures, configurations, constructions, applications, systems and methods for implementing or carrying out the gist, essence, objects and/or purposes of the present invention.

In regards to the above embodiments, diagrams and descriptions, those of skill in the art will further appreciate that the optimum dimensional or other relationships for the parts of the present invention and disclosure, which include, but without limitation, variations in sizes, materials, substances, matters, shapes, scopes, forms, functions and manners of operations and inter-actions, assemblies and users, are deemed readily apparent and obvious to one skilled in the art, and all equivalent relationships and/or projections to or of those illustrated in the drawing figures and described in the specifications are intended to be encompassed by, included in, and form part and parcel of the present invention and disclosure. Accordingly, the foregoing is considered as illustrative and demonstrative only of the ideas or principles of the invention and disclosure. Further, since numerous hybrids, permutations, modifications, variations and/or equivalents will readily occur to those skilled in the art, it is not desired to limit the present invention and disclosure to the exact functionality, assembly, construction, configuration and operation shown and described, and accordingly, all suitable hybrids, permutations, modifications, variations and/or equivalents may be resorted to, falling within the scope of the present invention and disclosure.

It is to be understood that infrared radiation within the electromagnetic spectrum in the foregoing for illustrative purposes, without limitation of application of the present invention to radio-waves, microwaves, ultra-violet waves, x-rays, gamma rays and all other forms of radiation within or outside the electromagnetic spectrum except as it may be limited by the claims.

The invention claimed is:

1. A combined radiator and lighting assembly comprising:
at least a first radiation member powered by a first heating member and formed in an at least partial ring shape;
a reflection member including an at least partially ring-shaped concave reflective surface facing at the first radiation member for distributing energy to an at least partially ring-shaped area or zone;
a lamp socket assembly; and
at least a second radiation member adapted to be received by the lamp socket assembly,
the second radiation member including:
a thermal conductive layer; and
a radiation layer powered by a second heating member embedded in at least a portion of the thermal conductive layer; and
a thermal insulation layer facing the thermal conductive layer; and
at least one lamp base assembly coupled to the thermal insulation layer,
wherein the lamp base assembly is adapted to be received in the lamp socket assembly.

2. The combined assembly of claim 1, wherein the first radiation member is positioned along a focal zone of the reflective surface.

3. The combined assembly of claim 1, wherein the first radiation member includes an electrical resistance covered by or encased in a thermal conductive material.

4. The combined assembly of claim 1, wherein the first radiation member includes an electrical resistance covered by or encased in a metallic material or an oxide, sesquioxide, carbide, hydrate or nitrate of silicon material or metallic material.

5. The combined assembly of claim 4, wherein the encasing of the electrical resistance includes an at least partial tubular shape.

6. The combined assembly of claim 3, wherein the encasing of the electrical resistance includes an at least partial tubular shape.

7. The combined assembly of claim 6, wherein end(s) of the at least partial tubular-shaped encasing of the electrical resistance is/are turned towards and pass through aperture(s) on the at least partially ring-shaped concave reflective surface of the reflection member and the end(s) is/are stowed and secured at location(s) within the recess(es) behind the concave reflective surface.

8. The combined assembly of claim 1, wherein the reflection member has a generally ring shape.

9. The combined assembly of claim 1, wherein the first radiation member has a generally ring shape.

10. The combined assembly of claim 1, wherein the second radiation member includes at least one light source or radiation source coupled with the lamp base assembly, which fits into the lamp socket assembly.

11. The combined assembly of claim 1, wherein the radiation layer of the second radiation member is positioned between the thermal insulation layer and the thermal conductive layer.

12. The combined assembly of claim 1, wherein the thermal conductive layer of the second radiation member includes a metallic material or an oxide, sesquioxide, carbide, hydrate or nitrate of silicon material or metallic material.

13. The combined assembly of claim 1, wherein the thermal conductive layer of the second radiation member includes a gaseous or liquid material.

14. The combined assembly of claim 1, wherein:
the thermal conductive layer of the second radiation member includes a partially spherically-shaped segment defining a center point or a focal zone;
the radiation layer of the second radiation member includes a partially spherical shape defining a center point or a focal zone; and
the center point or the focal zone of the said thermal conductive layer generally coincides with the center point or the focal zone of the radiation layer.

15. The combined assembly of claim 14, wherein:
the thermal insulation layer includes a partially spherical shape defining a center point or a focal zone;

the center point or the focal zone of the thermal insulation layer generally coincides with the center point or the focal zone of the radiation layer and the center point or the focal zone of the thermal conductive layer.

16. The combined assembly of claim 14, wherein the thermal insulation layer includes a concave side facing a convex side of the thermal conductive layer, so that the radiation layer of the second radiation member increases a temperature of the thermal conductive layer and concentrates energy to the center point or the focal zone of the radiation layer.

17. The combined assembly of claim 14, wherein the thermal insulation layer includes a convex side facing a concave side of the thermal conductive layer, so that the radiation layer of the second radiation member increases a temperature of the thermal conductive layer and disperses energy away from the center point or the focal zone of the radiation layer.

18. The combined assembly of claim 15, wherein the thermal insulation layer includes a concave side facing a convex side of the thermal conductive layer, so that the radiation layer of the second radiation member increases a temperature of the thermal conductive layer and concentrates energy to the center point or the focal zone of the radiation layer.

19. The combined assembly of claim 15, wherein the thermal insulation layer includes a convex side facing a concave side of the thermal conductive layer, so that the radiation layer of the second radiation member increases a temperature of the thermal conductive layer and disperses energy away from the center point or the focal zone of the radiation layer.

* * * * *